US005553926A

United States Patent [19]

Blackstock et al.

[11] Patent Number: 5,553,926

[45] Date of Patent: Sep. 10, 1996

[54] SELF-PROPELLED MINING APPARATUS AND METHOD FOR CUTTING ARCHED OPENING

[75] Inventors: Jon C. Blackstock, Ironton, Ohio; John A. Baird, Jr., Flatwoods; Ian T. Carr, Ashland, both of Ky.

[73] Assignee: Mining Technologies, Inc., Ashland, Ky.

[21] Appl. No.: 343,694

[22] Filed: Nov. 22, 1994

[51] Int. Cl.[6] ..... E21C 27/24; E21C 29/22

[52] U.S. Cl. ..... 299/10; 299/64; 299/78

[58] Field of Search ..... 299/55, 56, 64, 299/76, 78, 80, 87, 10; 405/138

[56] References Cited

U.S. PATENT DOCUMENTS

| | | | |
|---|---|---|---|
| 2,756,037 | 7/1956 | Kirkpatrick | 299/55 X |
| 3,516,712 | 6/1970 | Bennett | 299/76 X |
| 3,774,969 | 11/1973 | Lebegue | 299/76 |
| 3,922,016 | 11/1975 | Tyslauk et al. | 299/31 |
| 4,162,104 | 7/1979 | Kogler et al. | 299/75 |
| 4,441,761 | 4/1984 | Fields et al. | 299/64 |

FOREIGN PATENT DOCUMENTS

| | | | |
|---|---|---|---|
| 1018185 | 11/1991 | WIPO | 405/138 |

OTHER PUBLICATIONS

Crickmer, Douglas F. et al.; Elements of Practical Coal Mining; 2nd Edition; pp. 450–451; 1981.

SEIB Warren T.; Advances in Highwall Mining; Third Large Open PT Mining Conference; Aug. 30–Sep. 3, 1992; pp. 145–150.

*Primary Examiner*—David J. Bagnell

*Attorney, Agent, or Firm*—King and Schickli

[57] ABSTRACT

A mining apparatus includes a frame, a mechanism for cutting an arched opening in a seam and winning the cut mineral, and a propulsion system. The cutting mechanism includes a boom supported mineral cutting drum having a barrel or bulging cylindrical shape. The propulsion system is canted on the frame at an angle from the horizontal in order to match the floor of the arched opening being cut by the drum.

18 Claims, 3 Drawing Sheets

SELF-PROPELLED MINING APPARATUS AND METHOD FOR CUTTING ARCHED OPENING

TECHNICAL FIELD

The present invention relates generally to the art of mining, and more particularly, to an improved mining apparatus adapted for utilization in a highwall mining system for winning aggregate material such as coal from a mineral seam.

BACKGROUND OF THE INVENTION

A highwall mining system has recently been developed by Mining Technologies, Inc. and is generally described in, for example, U.S. Pat. Nos. 5,112,111 and 5,261,729 to Addington et al. Highwall mining is particularly useful where the coal seam is located at a significant depth below the surface and the amount of overburden that must be removed to reach the coal makes further strip mining economically unfeasible.

The highwall mining system includes a self-propelled miner or mining machine for cutting material from the seam and a conveyor for conveying the won aggregate material from the mining machine for recovery. The conveyor is formed by a series of individual conveyor units that are coupled or interconnected in series so as to form a train. The last unit of the conveyor train is supported on a launch vehicle anchored to the bench outside the mineral seam. The launch vehicle includes an underlying belly conveyor that receives aggregate material from the last unit of the conveyor train and delivers this material to a discharge conveyor for loading a coal transportation vehicle.

In the past, the mining machine adapted for utilization in such a highwall mining system has generally comprised a continuous miner of conventional design. Such a miner is typically of the milling or drum-type that breaks coal through the picking action of bits arranged in a pattern over the surface of a cylindrical drum rotated parallel to the coal face. The drum is mounted on a boom structure or support that raises or lowers so that the rotating drum may be fed or sumped into the coal at the roof line of the cut and then moved down through the solid coal toward the mine bottom or floor of the cut. There a gathering pan, with loading arms, pulls the coal into a self-contained conveyor system for subsequent transfer of the coal from the rear of the miner.

Such a continuous mining machine is particularly useful and efficient in the mining of coal in accordance with room-and-pillar and shortwall mining methods. A conventional continuous miner does, however, have some drawbacks or disadvantages when operating within the scheme of a highwall mining system.

More specifically, as disclosed and discussed in detail in co-pending U.S. patent application Ser. No. 08/328,642, filed Oct. 25, 1994, and entitled "Continuous Miner" (the full disclosure of which is incorporated herein by reference), one important drawback relates to the provision of the gathering mechanism including independent gathering arms that operate on the gathering pan to feed cut coal into the self-contained conveyor system. This is a bulky, space consuming system that is expensive to maintain.

Another drawback relates to utilization of a cylindrical drum that cuts a rectangular opening in the seam. Such an opening leaves a straight, horizontal roof line. As coal is won from the mineral seam, the previous equilibrium of the geologic strata is upset and stresses develop. A straight horizontal roof line is generally not capable of handling or distributing these stresses efficiently and, accordingly, the roof fall risk is significantly increased. While no individuals are underground in the drive cut in the seam by the highwall mining system, such a roof fall would cause production delays and could even limit the depth of mining penetration of any particular drive. Further, a severe roof fall could actually trap the continuous miner and other equipment underground. Accordingly, all possible efforts should be made to minimize the risk of roof fall in any highwall mining operation.

A need is therefore identified for an improved, self-propelled mining apparatus capable of cutting an opening or drive in a seam having a roof line of greater structural integrity and stability.

SUMMARY OF THE INVENTION

Accordingly, it is a primary object of the present invention to provide a mining apparatus in the form of a continuous miner overcoming the above-identified limitations and disadvantages of the prior art.

Another object of the present invention is to provide a mining apparatus for cutting an opening or drive in a mineral seam having a continuously arched roof line that characteristically produces a stronger and more stable roof structure and effectively minimizes the risk of a roof fall.

Yet another object of the present invention is to provide a continuous miner for utilization in a highwall mining system that incorporates a cutting drum of barrel or bulging cylindrical shape to cut an arched opening or drive in a mineral seam. Further, the continuous miner includes a propulsion system having crawler assemblies angled relative to the horizontal to match the arch of the floor cut by the drum as mining continues so as to provide enhanced traction under substantially all operating conditions.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus is provided for mining mineral from a mineral seam. The apparatus includes a frame and means for cutting an arched opening in and winning mineral from the seam. The apparatus also includes a means for propelling the apparatus into the seam. Both the cutting and winning means and the propelling means are mounted to the frame.

More specifically, the cutting and winning means includes a mineral cutting drum having a bulging cylinder or barrel shape; that is, the greatest diameter of the drum is at its midline and it gradually tapers toward opposite lateral ends. Accordingly, the cutting drum cuts an arched opening including a substantially continuous arcuate or arched roof line that is stronger and more stable so as to better resist roof fall.

The cutting and winning means also includes a boom pivotally mounted to the frame for operatively supporting the mineral cutting drum. Thus, the drum may be raised and lowered when cutting mineral from the seam. In addition, the cutting and winning means includes a loading shovel connected to the frame and underlying the mineral cutting drum along the floor of the opening. Preferably, the loading shovel also includes a means for conveying mineral cut from the seam by the mineral cutting drum.

More specifically, the conveying means is in the form of a chain conveyor with spaced flights provided on the floor pan of the loading shovel immediately adjacent to the lead lip. Still more preferably, the lead lip is arched so as to substantially correspond in contour to the bulging cylinder shape of the mineral cutting drum. Thus, the lead lip substantially matches and follows the contour of the floor cut by the cutting drum. In this way, the loading shovel provides for more sufficient collecting of cut coal thereby reducing the amount of waste product that would otherwise be left on the mine floor.

Further, it should be appreciated that with its matching contour, the loading shovel essentially nests in the mine floor and therefore functions to aid in the guiding of the mining apparatus in a straight line as it advances further into the mineral seam. Accordingly, a straight drive results and the prospect of breaking through a web into an adjacent drive is substantially reduced. Thus, a drive may be mined to its greatest possible extent or depth for maximum recovery. Further, lost production time resulting from the miner becoming "hung-up" after breaking through a web into another drive is virtually eliminated. So overall productivity is increased.

The propulsion means is preferably a pair of cooperating crawler assemblies powered by hydraulic or electric motors. One crawler assembly is mounted on each side of the frame. Of course, as noted above, the mineral cutting drum of bulging cylinder shape leaves an arched floor. Advantageously, the crawler assemblies of the mining apparatus are, therefore, canted relative to the horizontal so as to correspond with the contour of the floor and bring the full traction faces of the crawler assemblies into engagement with that floor. The canting of the crawlers improves straight-line tracking. Further, the arched floor causes water to drain toward the middle of the floor away from the path of the crawler assemblies. As a result, full traction of the mining apparatus is obtained and more useful power is available when sumping the mining apparatus forward into the mineral seam. This significantly improves mining efficiency and productivity.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
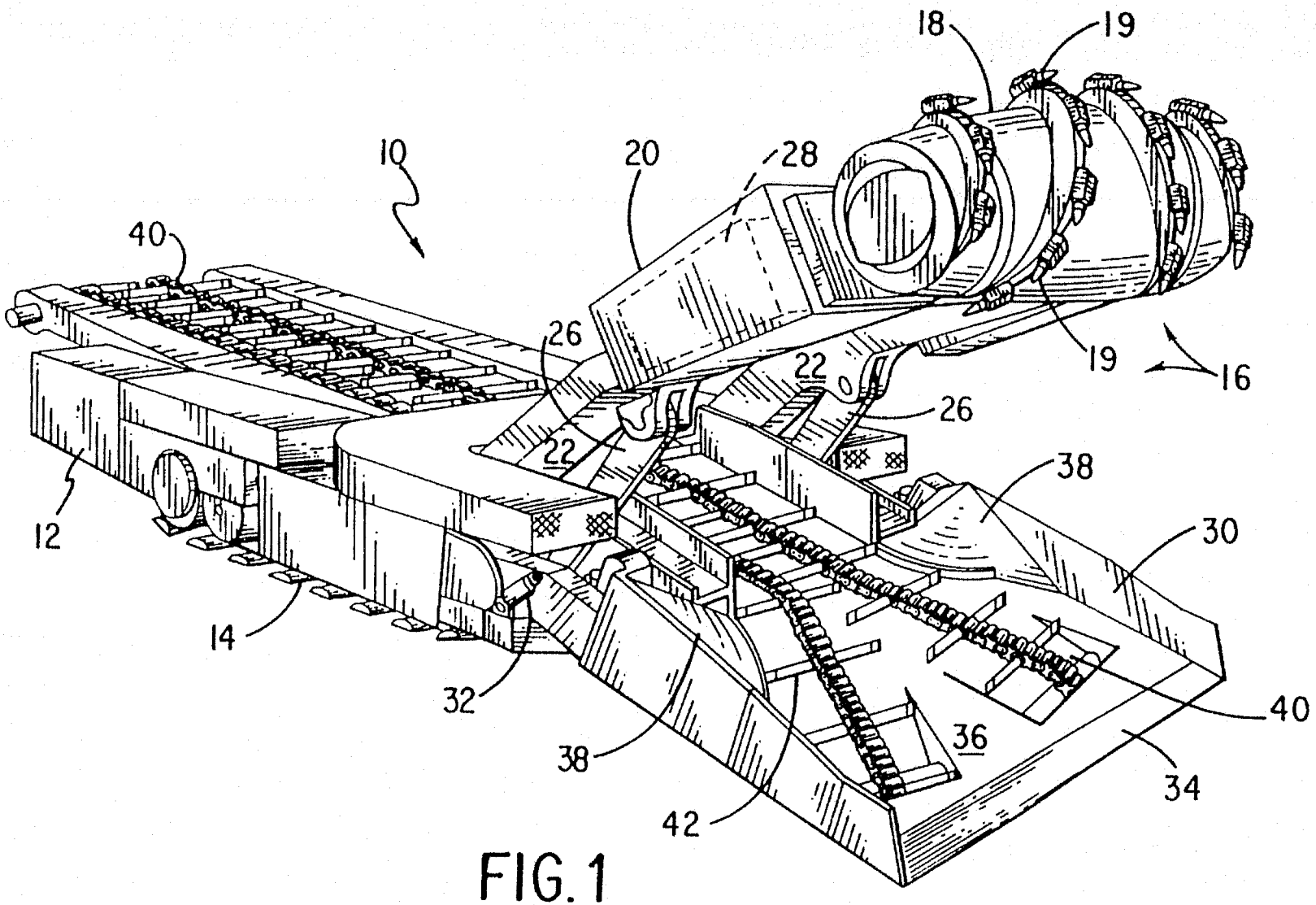
FIG. 1, is a perspective view of the mining apparatus of the present invention.
Figure 2:
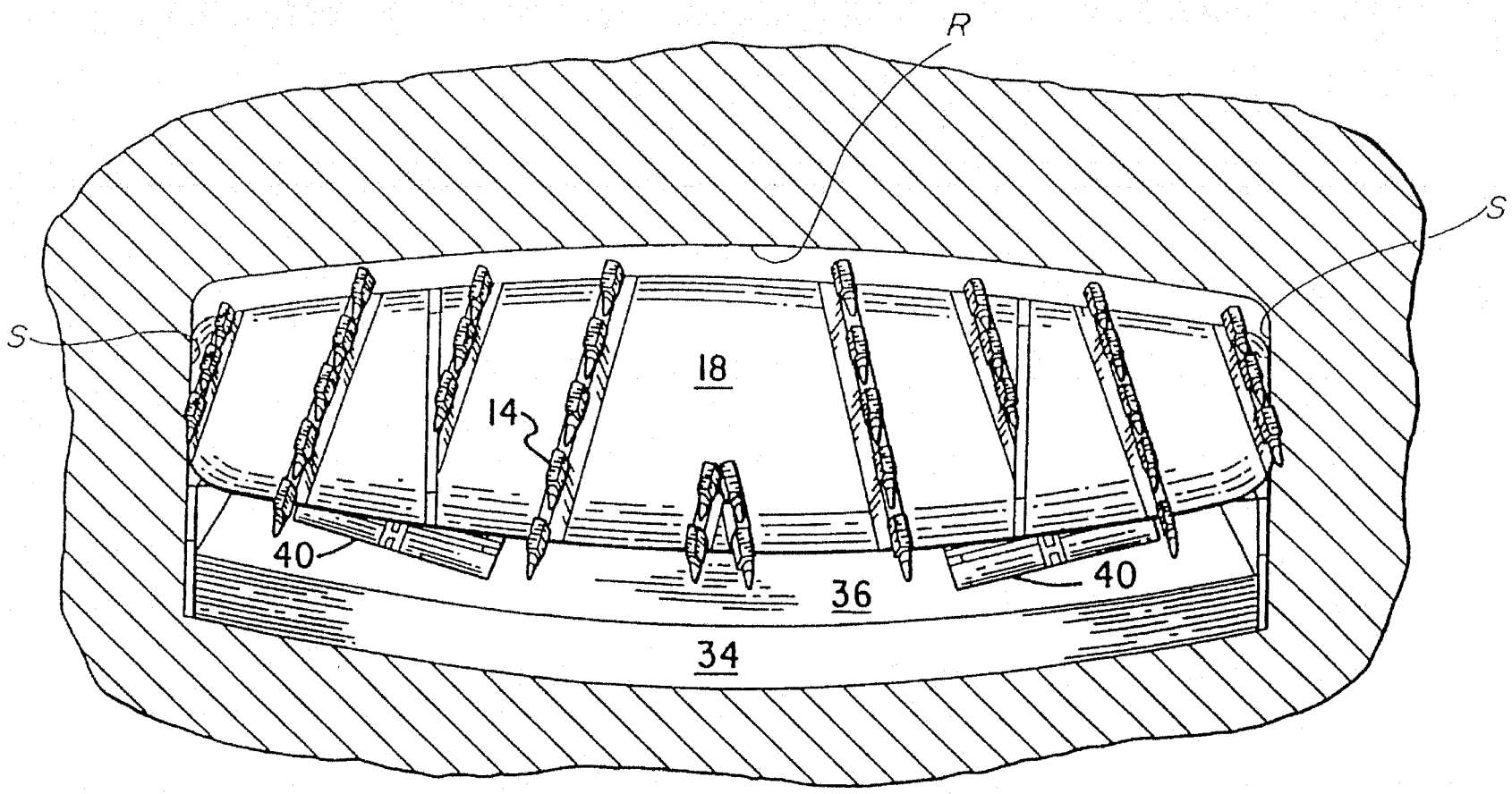
FIG. 2 is a front elevational view of the mining apparatus shown in FIG. 1 with the cutting drum raised slightly illustrating the relationship of the arched floor pan of the loading shovel with the mine floor.
Figure 3:
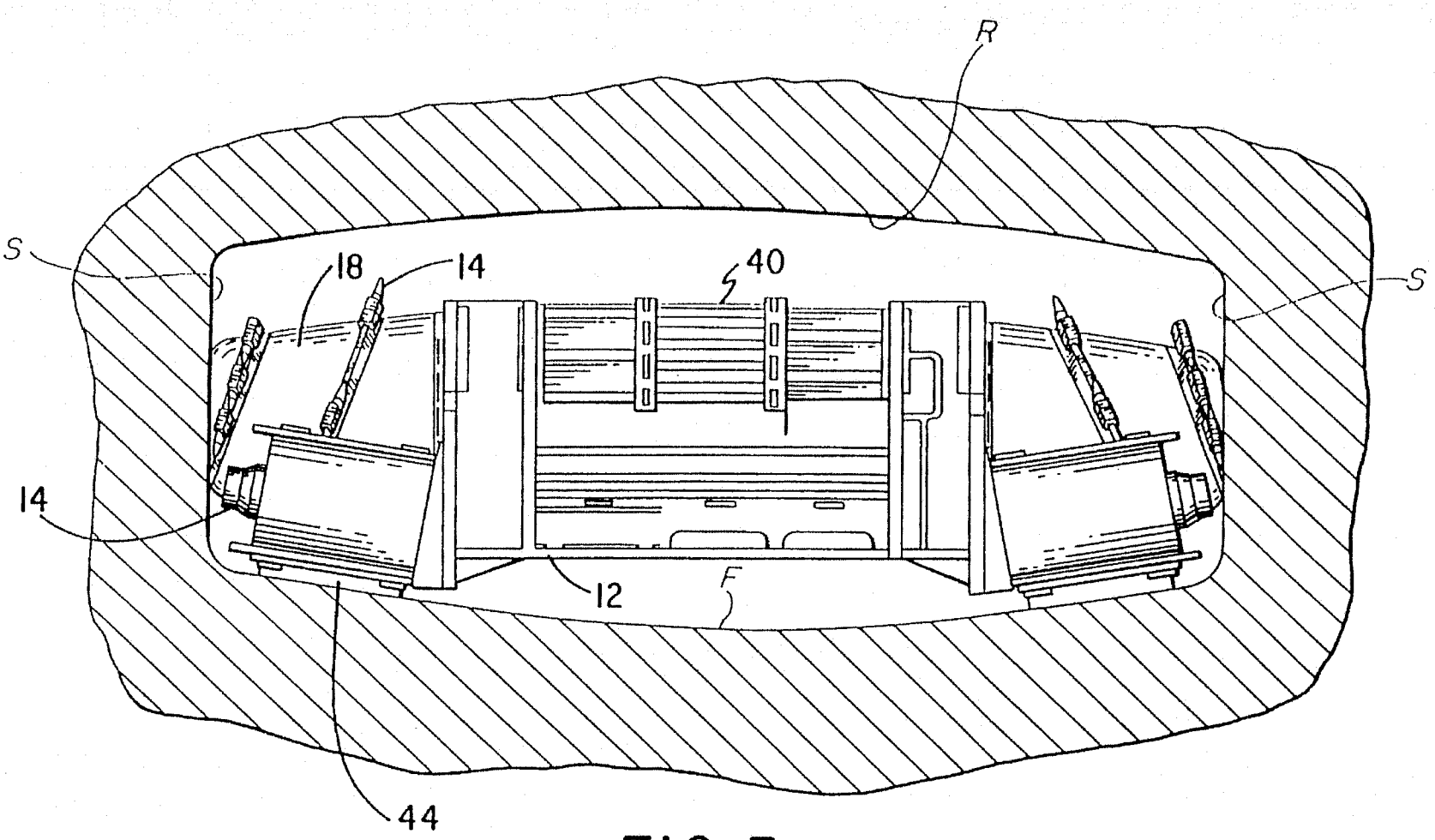
FIG. 3 is a rear elevational view of the mining apparatus illustrating the canted angle of the crawler assemblies matching the arched contour of the cutting drum and the mine or drive floor.

Reference is now made to FIGS. 1–3 showing the mining machine 10 of the present invention for the continuous mining of a mineral seam. Such a mining machine may be utilized in a highwall mining system of the type described in, for example, U.S. Pat. Nos. 5,112,111 and 5,261,729 to Addington et al. owned by the assignee of the present invention. The full disclosure presented in these patent documents is incorporated herein by reference.

Advantageously, highwall mining systems of the type described allow for operation in thin seams to a depth of penetration of substantially 5–10 times greater than that possible with conventional auger mining. Since a large percentage of the remaining coal reserves around the world exists in relatively thin seams too low to mine with current underground methods and so situated to make surface mining impractical, highwall mining is expected to move to the forefront of coal recovery methods in the future.

As shown, the mining machine 10 includes a main frame 12 supported for moving or propelling relative to the ground by means of a pair of canted crawler assemblies 14, one on each side of the mining machine. These crawler assemblies 14 are powered by electric or hydraulic motors, only one shown schematically at 15, carried on the frame 12 in a manner well known in the art. The crawler assemblies 14 will be described in greater detail below.

The mining machine 10 also includes a means, generally designated by reference numeral 16, for cutting an arched opening in and winning aggregate material from the mineral seam. More particularly, the cutting and winning means 16 includes a three piece rotary mineral cutting drum 18 carried on the forward end of a boom 20 that is pivotally mounted to the frame 12. More specifically, as known in the art the cutting drum 18 includes a series of picks 19 for ripping, breaking or cutting aggregate material from the mineral seam for subsequent recovery. The rotary cutting drum 18 is arched and of substantially barrel or bulging cylindrical shape as shown so as to have a greater diameter at its midline while gradually tapering toward its lateral ends. Preferably, the cutting drum has a longitudinal, end-to-end radius of curvature of between 150–500 inches. In this way, the cutting drum 18 cuts a drive with a correspondingly, continuously arched or rounded roof line. This roof line provides for better distribution of the stresses and pressures generated in the geologic strata by the mining operation and, therefore, better overall roof support. Hence, the risk of roof fall is significantly reduced.

The boom 20 includes a pair of spaced, lateral arms 22, each arm being pivotally mounted to the frame 12 through a trunnion (not shown). A pair of hydraulic actuators 26 allow the selective angular positioning of the boom 20 relative to the frame 12. One actuator 26 is operatively connected between the frame 12 and each of the boom arms 22. As should also be appreciated, one motor (shown schematically at 28) and cooperating gear case (not shown) are carried by each arm 22 to drive the cutting drum 18.

As best shown in FIGS. 1 and 2, a loading shovel 30 is pivotally mounted to the front of the frame 12 so as to extend in a forward direction immediately below the boom 20 and below and behind the cutting drum 18. The orientation of the loading shovel 30 relative to the frame 12 is controlled by a pair of hydraulic actuators 32 (only one shown in FIG. 1) mounted on the frame 12. One actuator is operatively connected to each side of the loading shovel 30.

The loading shovel 30 includes an inclined, reinforced lip 34, a floor pan 36 and a pair of cooperating sidewalls 38 that form a scoop. The lip 34 and floor pan 36 of the loading shovel 30 are arched in profile to match the shape of the mine floor cut by the cutting drum 18 as the mining machine 10 is advanced into the drive (see particularly FIG. 3, noting mine floor F).

As shown in FIGS. 1 and 2, a rear section of the sidewalls 38 converge toward a twin chain conveyor 40 as they extend in a rearward direction. The twin chain conveyor 40 may include a series of aligned flights 42. Alternatively, however, it should be appreciated that the flights 42 may be provided in an interdigitating configuration. As best illustrated by reference to FIGS. 1 and 3, the conveyor 40 conveys coal cut by the cutting drum to the rear of the mining apparatus 10 where it may be discharged onto a conveyor train (not shown) for subsequent conveyance through the drive to the mining bench for ultimate recovery.

A number of advantages result from the unique design of the mining machine 10 of the present invention. More specifically, as highwall mining requires cutting only in a straight direction it should be appreciated that the arched or bulging cylinder or barrel shaped cutting drum 18 cuts an arched opening or drive in the coal seam. More specifically, as the cutting drum 18 has a wider diameter in the middle and gradually tapers toward each side or end, the resulting roof line R and floor line F defined between the two sidewalls S of the drive are substantially continuously arcuate or arched (see particularly FIGS. 2 and 3). Accordingly, the stress and pressures produced by the overburden are better distributed so as to be supported by the sidewalls or webs of the drive. The risk of roof fall is therefore significantly reduced and as a result, mining efficiency and productivity is enhanced. In particular, by reducing the number of roof fall episodes, more time may be spent in the winning of coal than in equipment recovery and repair. Further, each drive may effectively be mined to its fullest depth so that a greater percentage of the available coal is recovered.

In accordance with yet another important aspect of the present invention, the lip 34 of the loading shovel 30 is contoured so to include an arch or profile substantially corresponding to the arch of the floor cut by the cutting drum 18. As a result, the lip 34 of loading shovel 30 "nests" in the floor (see particularly FIG. 2) and substantially all the cut coal is scooped up and collected in the loading shovel and little or no coal is left on the mine floor. Further, it should be appreciated that the matching contours of the mine floor and lip 34 function to direct and guide the mining machine 10 in a straight line. Specifically, any side movements are resisted by engagement of the lip 34 with the mine floor. Similarly, side movements are also resisted by engagement of the loading shovel sidewalls 38 with the webs of the drive. As a result, the mining machine 10 follows a true and straight line for the full depth of the drive. The risk of cutting through a web and breaking into an adjacent drive is therefore minimized. Accordingly, the full depth of the drive may be mined with confidence.

Yet another important aspect of the present invention relates to the canting of the crawler assemblies 14 at an angle with respect to the horizontal so as to match the arched contour or slope of the mine floor as cut by the cutting drum 18. More particularly, as shown in FIG. 3, it should be appreciated that the crawler assemblies include a track face 44. The track face 44 is angled relative to the horizontal between 0.1°–45° so as to match and fully engage the mine floor. In this way, the traction of the mining machine 10 is maximized for more useful power application when sumping the mining machine forward into the coal seam or when backing the miner and the interconnected units of the conveyor train from the drive. As a result, mining efficiency is again enhanced as is productivity.

In summary, numerous benefits result from employing the concepts of the present invention. The mining machine 10 of the present invention advantageously cuts a drive having a continuously arched roof line having a radius of curvature of between 150–500 inches that is more stable and resistant to roof fall. Further, both the coal loading shovel 30 and crawler assemblies 14 are custom designed to match the resulting arched floor line to maximize coal loading efficiency and application of tractive power. As a result, a more efficient and productive mining apparatus 10 is provided particularly adaptive for utilization in highwall mining systems where straight cuts or drives are desired.

The foregoing description of a preferred embodiment of the invention has been presented for purposes of illustration and description. It is not intended to be exhaustive or to limit the invention to the precise form disclosed. Obvious modifications or variations are possible in light of the above teachings. Further, it should be appreciated that the present invention is not limited to highwall mining applications and may in fact be used in underground mining. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An apparatus for mining mineral from a seam, comprising:

a frame;

means for cutting an opening in the seam and winning mineral from the seam mounted to said frame, said cutting and winning means including a mineral cutting drum having a midline of greatest diameter gradually tapering toward opposed ends providing a radius of curvature of between 150–500 inches for cutting an opening including a substantially continuously arched roof and floor defined between two sidewalls; and means for propelling said apparatus, said propelling means being mounted to said frame.

2. The mining apparatus set forth in claim 1, wherein said cutting and winning means further includes a boom pivotally mounted to said frame for operatively supporting said mineral cutting drum.

3. The mining apparatus set forth in claim 2, wherein said cutting and winning means further includes a loading shovel connected to said frame and underlying said mineral cutting drum.

4. The mining apparatus set forth in claim 3, wherein said cutting and winning means further includes means on said loading shovel and said frame for conveying mineral cut from the seam by said mineral cutting drum.

5. The mining apparatus set forth in claim 1, wherein said cutting and winning means further includes a loading shovel connected to said frame and underlying said cutting means.

6. The mining apparatus set forth in claim 5, wherein said cutting and winning means further includes means on said loading shovel and said frame for conveying mineral cut from the seam by said mineral cutting drum.

7. The mining apparatus set forth in claim 1, wherein said propulsion means includes a pair of cooperating crawler assemblies and means for driving said crawler assemblies.

8. The mining apparatus set forth in claim 7, wherein one of said crawler assemblies is mounted on a first side of said frame and another of said crawler assemblies is mounted on a second side of said frame, said crawler assemblies being canted relative to the horizontal so as to engage the arched floor defined between the two sidewalls as cut by said mineral cutting drum in the seam.

9. The mining apparatus set forth in claim 8, wherein said crawler assemblies are canted to deviate from the horizontal by between 0.1°–45.0°.

10. An apparatus for mining mineral from a seam comprising:

a frame: and a rotary drum mounted to said frame for cutting mineral from the seam, said rotary drum having an arched profile and including a midline of greatest diameter gradually tapering toward lateral ends of said drum so as to provide a radius of curvature of between substantially 150–500 inches.

11. An apparatus for mining mineral from a seam, comprising a frame;

means for cutting an arched opening in and winning mineral from the seam, said cutting and winning means being mounted to said frame, said cutting and winning means further comprising;

(A) a mineral cutting drum having a midline of greatest diameter gradually tapering toward opposite ends providing a radius of curvature of between 150–500 inches;

(B) a boom pivotally mounted to said frame for operatively supporting said mineral cutting drum; and (C) a loading shovel connected to said frame and underlying said mineral cutting drum, said loading shovel including an arched floor pan substantially corresponding in contour to said mineral cutting drum; and means for propelling said apparatus, said propelling means being mounted to said frame.

12. The mining apparatus set forth in claim 11, wherein said propulsion means includes a pair of cooperating crawler assemblies and means for driving said crawler assemblies.

13. The mining apparatus set forth in claim 12, wherein one of said crawler assemblies is mounted on a first side of said frame and another of said crawler assemblies is mounted on a second side of said frame, said crawler assemblies being canted relative to the horizontal so as to engage an arched floor as cut by said mineral cutting drum.

14. The mining apparatus set forth in claim 13, wherein said crawler assemblies are canted to deviate from the horizontal by between 0.1°–45.0°.

15. An apparatus for mining mineral from a seam comprising:

a frame;

a cutter that is contoured for cutting an arched opening in and winning material from the seam, said cutter being mounted to said frame;

a loading shovel connected to said frame and underlying said cutter, said loading shovel including an arched floor pan substantially corresponding in contour to said cutter; and means for propelling said apparatus, said propelling means being mounted to said frame.

16. The mining apparatus set forth in claim 15, wherein said propulsion means includes a pair of cooperating crawler assemblies and means for driving said crawler assemblies.

17. The mining apparatus set forth in claim 16, wherein one of said crawler assemblies is mounted on a first side of said frame and another of said crawler assemblies is mounted on a second side of said frame, said crawler assemblies being canted relative to the horizontal so as to engage an arched floor as cut by said mineral cutting drum.

18. The mining apparatus set forth in claim 17, wherein said crawler assemblies are canted to deviate from the horizontal by between 0.1°–45.0°.

* * * * *